US005533910A

United States Patent [19]

Körner et al.

[11] Patent Number: 5,533,910

[45] Date of Patent: Jul. 9, 1996

[54] ELECTRICAL CONNECTOR

[75] Inventors: André Körner; Reinhard Wostmann, both of Lippstadt, Germany

[73] Assignee: Hella KG Hueck & Co., Lippstadt, Germany

[21] Appl. No.: 328,699

[22] Filed: Oct. 25, 1994

[30] Foreign Application Priority Data

Nov. 24, 1993 [DE] Germany ..... 43 40 032.9

[51] Int. Cl.[6] ..... H01R 4/24

[52] U.S. Cl. ..... 439/395; 439/404

[58] Field of Search ..... 439/395, 404, 439/405

[56] References Cited

U.S. PATENT DOCUMENTS

| | | | |
|---|---|---|---|
| 3,636,500 | 1/1972 | Sedlacek | 439/395 |
| 4,012,102 | 3/1977 | Cherney et al. | 439/404 |
| 4,230,391 | 11/1980 | Keglewitsch | 439/395 |
| 4,909,754 | 3/1990 | Paradis | 439/395 |
| 5,131,863 | 7/1992 | Gerke et al. | 439/395 |

FOREIGN PATENT DOCUMENTS

| | | | |
|---|---|---|---|
| 2339041 | 2/1974 | Germany . | |
| 2168858 | 6/1986 | United Kingdom | 439/395 |

*Primary Examiner*—P. Austin Bradley
*Assistant Examiner*—Jill DeMello
*Attorney, Agent, or Firm*—Griffin, Butler, Whisenhunt & Kurtossy

[57] ABSTRACT

An electrical connector, or coupling, includes a connecting lug (1) formed as a tongue-shaped metal plate which has a substantially slit-shaped recess (3) for receiving a wire. In an area of the recess a stamping is made in the connecting lug (1). By these means also wires with particularly small cross sections can be coupled to the connecting lug (1) by a force fit (friction) and a shape-interlock.

11 Claims, 3 Drawing Sheets

ELECTRICAL CONNECTOR

BACKGROUND OF THE INVENTION

This invention concerns an electrical connector, or coupling, which includes a connecting lug formed as a tongue-shaped metal plate which has a substantially slit-shaped recess for holding a wire.

Such an electrical connector is, for example, disclosed in German Offenlegungsschrift DE-OS 2 339 041 in which a slit-shaped recess of a connecting lug is formed by a blade, or cutting edge.

When an insulated wire lead is shoved into the recess, the recess edge cuts into the insulation and clamps the wire lead tightly, thereby providing a mechanical connection as well as an electrical connection to the wire lead. For this reason such connectors, or couplings, are sometimes called cut-clamp connectors.

Because recesses of such connectors are generally manufactured by punch machines, the recess cannot, because of technical manufacturing reasons, be narrower than a material thickness of the connecting lug (otherwise, the punching tool must be so thinly constructed that it is mechanically less stable than the work piece to be punched).

It follows from this that the connector of the prior art, which should exhibit a particular mechanical stability, has the disadvantage of only being able to hold wire leads with relatively large cross sections; or conversely, that connectors for receiving wires with small cross sections must have particularly thin walls and be mechanically unstable.

With known cut-clamp connectors the recesses are enlarged by wire leads which are shoved therein. A clamping force which is thereby created fixes the wire with a force fit, by means of static friction. From a stand point of providing a particularly good electrical and mechanical connection, it would be desirable to have a shape-, or form-, interlock; or better yet, an additional shape-interlock connection between the wire lead and the connecting lug.

It is therefore an object of this invention to provide an electrical connector which is relatively easy and cost effective to manufacture and which makes possible a particularly reliable and electrically and mechanically strong connection between a wire and a connecting lug; and with which a cross section of the wire can be substantially smaller than a thickness of the connecting lug.

SUMMARY OF THE INVENTION

According to principles of this invention, a connecting lug has at least one stamping in an area of a slit-shaped recess. By means of this at least one stamping on the connecting lug, which will participate in creating a connection, the wire will not only have a force fit but will also have a shape-interlocked fit whereby a high mechanical sturdiness of the connector results. By means of the stamping being made after the connecting lug has been punched out, also wires with very small cross sections can be used. Without these stampings, wire cross sections which could be used therewith would be limited to those greater than the thickness of the connecting lug.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
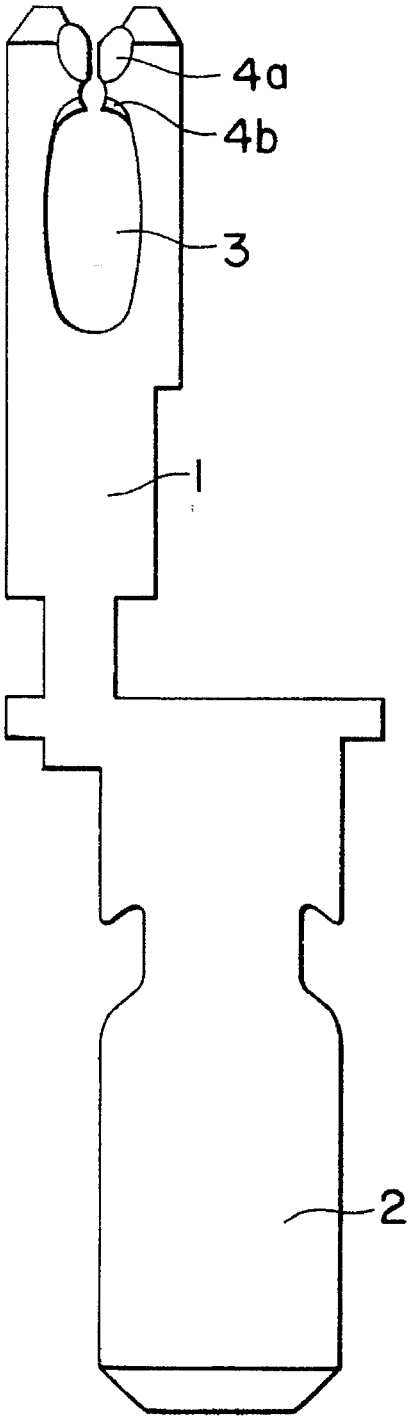
FIG. 1 is a side view of an electrical connection of this invention which is coupled as one piece with a flat plug.

FIG. 1 shows an electrical connector, or coupling, of this invention including a connecting lug 1 formed as a tongue-shaped metal plate having a substantially slit-shaped recess 3.

The connecting lug 1 is formed as one piece at its lower end with a flat plug 2 which, for example, can be inserted into a ground plate of an electrical apparatus or a relay.

At an upper portion of the connecting lug 1 two stampings, or stamped indentations, 4*a*, 4*b* can be seen.

Figure 2:
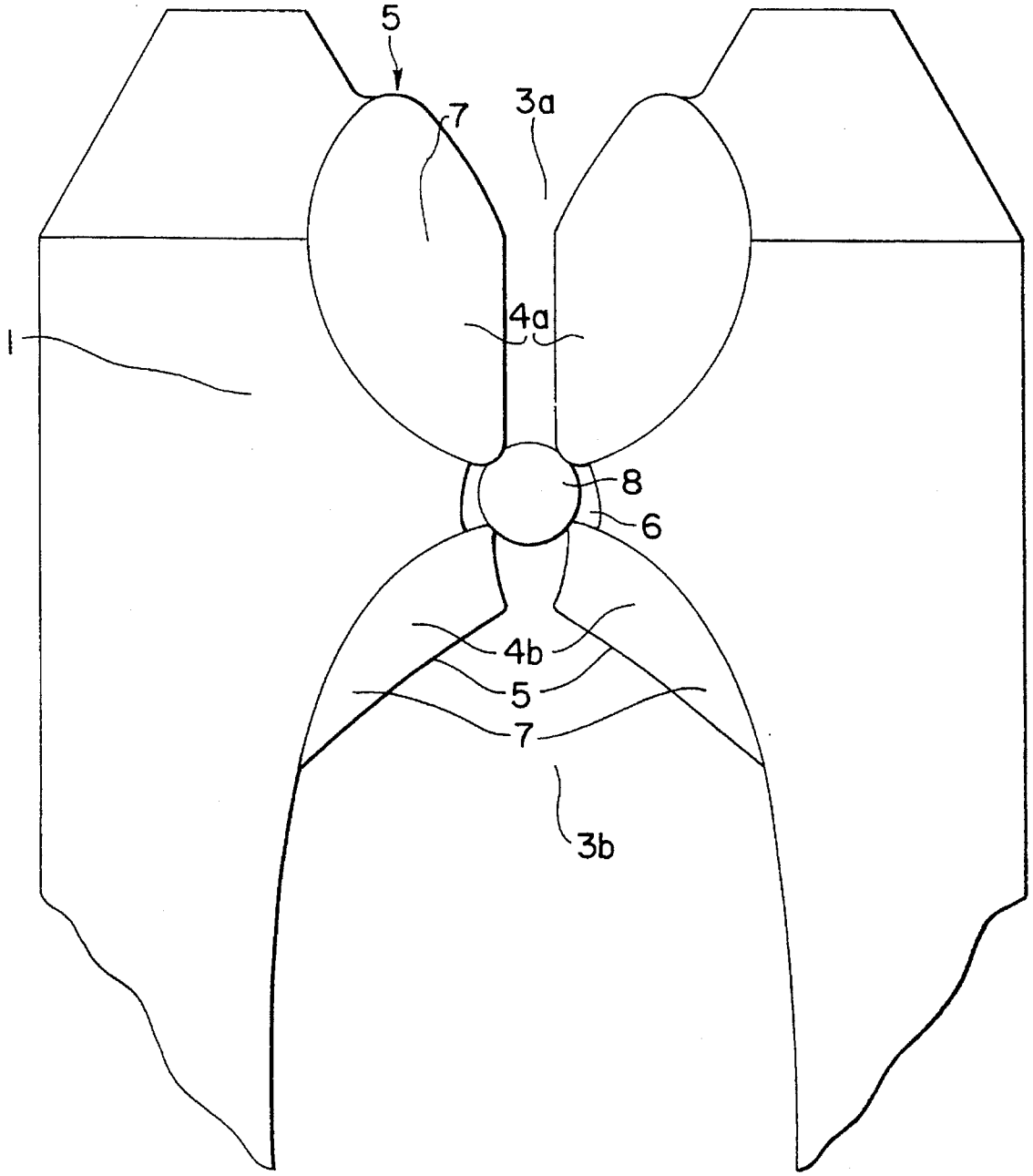
FIG. 2 is a segmented enlarged view of a portion of FIG. 1 but also includes a mounted wire lead.

An enlargement of the upper portion of the connecting lug 1 is shown in FIG. 2 for clarity.

The slit-shaped recess 3 of the connecting lug 1 is firstly divided into two areas 3*a*, 3*b* with the first area 3*a* of the recess being narrower than the second area 3*b*.

At each of the first area 3*a* of the recess 3 and a transition area from the first to the second area a stamping 4*a* and 4*b* is made with a circularly-shaped, stamping die. In this manner, somewhat-circular-segment-shaped flattened, or indentation, expansions 7 are made in the area of the recess on the connection lug 1, which flattened expansions extend into the recess.

In this manner, the narrow area 3*a* of the recess 3, which originally had a width which corresponded to at least a material thickness of the connecting lug 1 because of technical punching reasons, is made narrower.

Thus, a very thin wire 8 can also be connected to the connecting lug 1.

It is particularly beneficial that in the depicted embodiment the connecting lug 1 has two stampings thereon.

The stampings 4*a*, 4*b* are made so that between these stampings a smaller intermediate space 6 is created which has the original width of the recess 3 of the connecting lug 1. A wire 8, which can only be shoved from the top, as shown in the drawings, into the recess between opposite portions of the first stamping 4*a* will be deformed in its cross section by the very sharp edges of the stamping edge 5 of the first stamping 4*a*, while legs of the connecting lug are urged slightly away from one another.

When the wire 8 reaches the intermediate space 6 it will be held with a force fit as well as with shape interlocking by the flattened expansions 7, which extend substantially into the intermediate space 6.

In this manner, a particularly good mechanical and electrical connection between the wire 8 and the connecting lug 1 is created whereby the wire 8 can have a small cross section.

Figure 3:
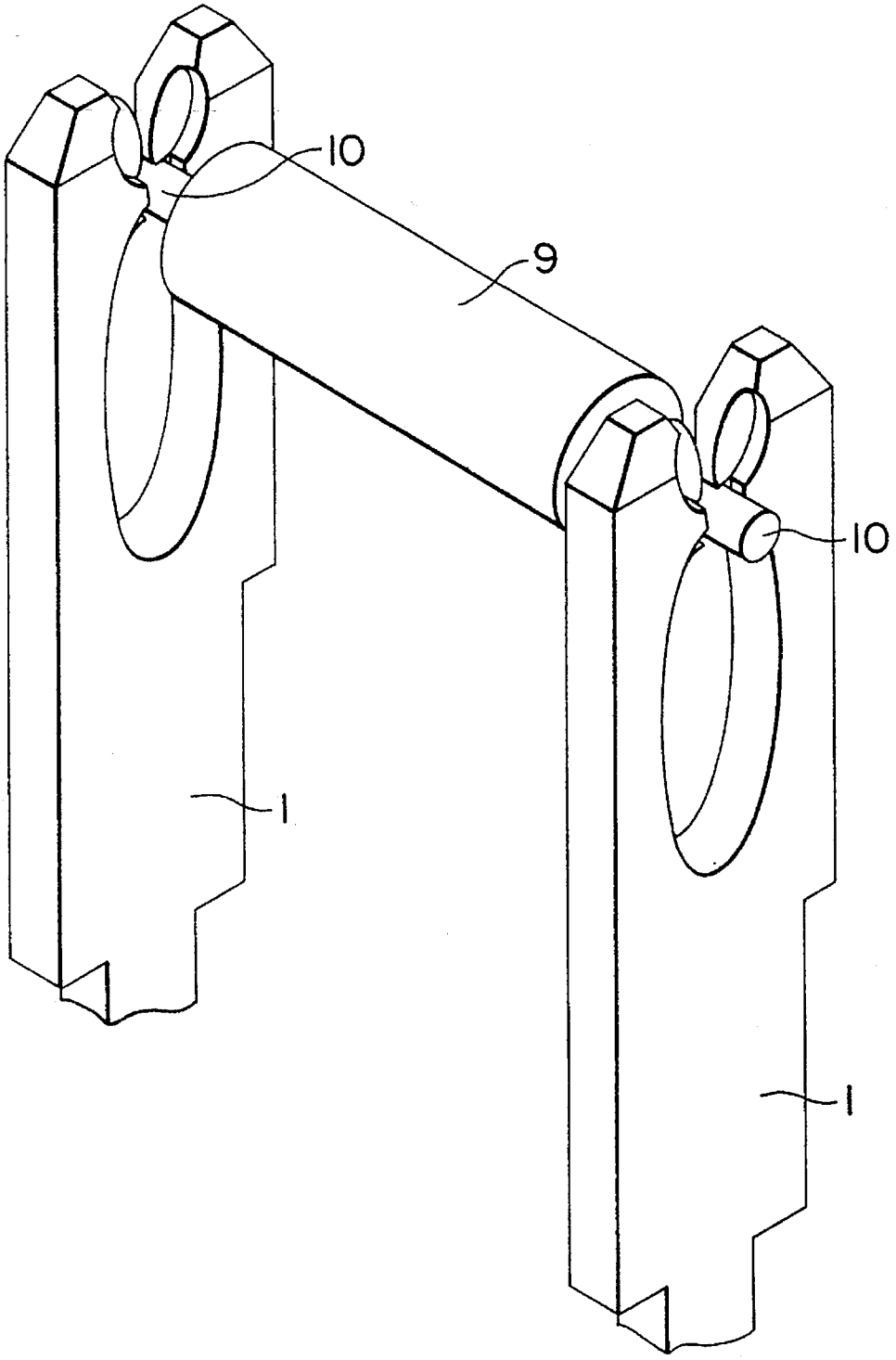
FIG. 3 is an isometric view of an apparatus including two electrical connectors of this invention coupled to an electrical element as an example of how this invention is used.

An example of how the electrical connector of this invention can be used is shown in FIG. 3. In this regard, two connecting lugs 1 stand parallel to one another and hold terminal wires 10 of a bipolar electrical or electronic component 9. The electrical, or electronic, component 9 placed between the connecting lugs 1 can be a protective, or isolating resistor, or a relaxation, or bypass, diode of an electromagnetic relay.

With such an application it is beneficial that the electrical connector functions as a cut-clamp connector. Indeed, here the connecting lugs must not cut through insulation because such components are generally sold without insulation. It is often the case, however, that the terminal wires 10 of the components 9 have lacquer coatings which extend, more or less, outwardly from the components, which were lacquered during their manufacture.

Such lacquer coatings, which can otherwise lead to insufficient contact, are here cut by the sharp stamped edges 5 whereby a reliable electrical connection is assured. Because of this, a rejection rate of apparatus can be substantially reduced by the electrical connector of this invention.

The invention claimed is:

1. An electrical connector comprising:

a connecting lug formed as a tongue-shaped metal plate which has a substantially elongated slit-shaped recess for receiving a wire;

wherein the connecting lug has at least two stampings made thereon in an area of the slit-shaped recess each of said two stampings defining a slit area of reduced width said two stampings being spaced from one another along said slit-shaped recess to define an intermediate space in said slit-shaped recess between said stampings of reduced width for holding a wire therebetween.

2. An electrical connector according to claim 1 wherein each of the stampings has a substantially circular shape.

3. An electrical connector according to claim 1 wherein the substantially slit-shaped recess is narrower in areas of the stampings, but there are still slit shaped recesses in the areas of the stampings.

4. An electrical connector as in claim 1 wherein the substantially slit-shaped recess has been punched in the connecting lug with a punching die.

5. An electrical connector as in claim 1 wherein is further included a wire that is held by the connecting lug and wherein the wire is a terminal wire of an electrical component.

6. An electrical connector as in claim 1 wherein is further included a wire that is held by the connecting lug and wherein a cross section of the wire held by the connecting lug is smaller than a material thickness of the connecting lug.

7. An electrical connector according to claim 1 wherein is further included a second connecting lug, said connecting lugs being arranged approximately parallel and opposite to one another and each receiving a separate terminal wire of an electrical component.

8. An electrical connector as in claim 1 wherein a distance between said two stampings is less than a diameter of said wire to be held in said intermediate space.

9. An electrical connecter as in claim 1 wherein each of said two stampings comprises a stamping of the lug on opposite sides of the slit-shaped recess.

10. An electrical connector according to claim 1 wherein the connecting lug is formed as one piece with a flat plug.

11. An electrical connector according to claim 10 wherein the flat plug is a component of an electromagnetic relay.

* * * * *